US009839799B2

(12) United States Patent
Siegemund

(10) Patent No.: US 9,839,799 B2
(45) Date of Patent: Dec. 12, 2017

(54) VEHICLE WITH FIRE PROTECTION APPARATUS

(71) Applicant: Bombardier Transportation GmbH, Berlin (DE)

(72) Inventor: Thomas Siegemund, Berlin (DE)

(73) Assignee: Bombardier Transportation GmbH, Berlin (DE)

( * ) Notice: Subject to any disclaimer, the term of this patent is extended or adjusted under 35 U.S.C. 154(b) by 189 days.

(21) Appl. No.: 14/433,809

(22) PCT Filed: Oct. 8, 2013

(86) PCT No.: PCT/EP2013/070932
§ 371 (c)(1),
(2) Date: Apr. 6, 2015

(87) PCT Pub. No.: WO2014/056902
PCT Pub. Date: Apr. 17, 2014

(65) Prior Publication Data

US 2015/0251029 A1 Sep. 10, 2015

(30) Foreign Application Priority Data

Oct. 9, 2012 (DE) ..... 10 2012 109 584

(51) Int. Cl.
*A62C 2/06* (2006.01)
*A62C 2/10* (2006.01)
*A62C 3/07* (2006.01)

(52) U.S. Cl.
CPC . *A62C 2/10* (2013.01); *A62C 3/07* (2013.01)

(58) Field of Classification Search
CPC .... B61D 7/20; B61D 7/22; A62C 2/00; A62C 2/04; A62C 2/06; A62C 8/06
See application file for complete search history.

(56) References Cited

U.S. PATENT DOCUMENTS 2,710,731 A 6/1955 Bright et al.
3,960,216 A * 6/1976 Isobe ..... A62C 2/10 160/1

FOREIGN PATENT DOCUMENTS

| | | | |
|---|---|---|---|
| CH | 691254 | A5 | 6/2001 |
| DE | 3713466 | A1 | 11/1988 |
| DE | 69307318 | T2 | 7/1997 |
| DE | 10056269 | A1 | 5/2002 |
| DE | 102010033481 | A1 | 2/2012 |
| EP | 0572199 | A1 | 12/1993 |
| FR | 2684008 | A1 | 5/1993 |
| GB | 2269097 | A | 2/1994 |

* cited by examiner

*Primary Examiner* — R. J. McCarry, Jr.
(74) *Attorney, Agent, or Firm* — The Webb Law Firm

(57) ABSTRACT

A vehicle with a partition area for passengers between two sections of the vehicle, wherein a fire protection apparatus is mounted in the ceiling region of the partition area and has a protective curtain that can be transferred from an idle position, in which the partition area is open, into a closed position in case of a fire. The protective curtain has at least two material webs that adjoin one another and partially overlap one another in the closed position, wherein the lower edge of the material webs that points toward the floor of the partition area is spaced apart from the floor in the closed position.

14 Claims, 2 Drawing Sheets

VEHICLE WITH FIRE PROTECTION APPARATUS

CROSS-REFERENCE TO RELATED APPLICATIONS

This application is the U.S national phase of International Application No. PCT/EP2013/070932 filed Oct. 8, 2013, and claims priority to German Patent Application No. 10 2012 109 584.1 filed Oct. 9, 2012, the disclosures of which are hereby incorporated in their entirety by reference.

BACKGROUND OF THE INVENTION

Field of the Invention

The invention concerns the field of vehicle engineering, particularly rail vehicle engineering, and pertains to a vehicle that features a fire protection apparatus with an integrated and activatable protective curtain, particularly a protective smoke and fire curtain for partially closing an open vehicle crossing.

Description of Related Art

Rail-bound commuter train vehicles such as subways, metropolitan railroads and light railroads are predominantly equipped with open crossings between the rail vehicle cars in order to thusly ensure an adequate passenger flow, to create an increased passenger capacity and to impart a subjective sense of safety. However, if a fire breaks out in one of the rail vehicle cars, smoke and fire can spread to the adjacent rail vehicle cars.

In most instances, a suitable fire protection measure is not provided. If the operator has to meet stricter requirements or has serious concerns, open crossings are eliminated or complex doors are provided in the crossing area.

A fire protection apparatus for rail vehicles is known, for example, from CH 691 254 A5, wherein this fire protection apparatus comprises a protective fire curtain that is activated in case of a fire and then completely closes an open crossing. A fire protection device is also described is DE 37 13 466 A1. U.S. Pat. No. 2,710,731 A describes a curtain to separate sections in an aircraft.

Fire protection apparatuses with protective fire curtains are, in principle, also known from the field of structural engineering, but these fire protection apparatuses are not suitable for rail vehicles. Examples of such fire protection apparatuses are described in DE 693 07 318 T2, FR 2 684 008 A1, EP 0 572 199 A1, DE 100 56 269 A1 and DE 10 2010 033 481 A1.

It is problematic that the solutions known so far are not sufficiently flexible and do not simultaneously fulfill the different requirements. For example, it would be desirable to ensure a reliable isolation of the source of the fire from other areas of the rail vehicle, but to simultaneously also provide the passengers with safe means of escape.

It therefore is the objective of the present invention to make available a fire protection apparatus that solves the above-described problems.

SUMMARY OF THE INVENTION

According to an embodiment, a vehicle, particularly a rail vehicle, with a partition area for passengers between two sections of the vehicle is proposed, wherein a fire protection apparatus is installed in the ceiling region of the partition area and comprises a protective curtain that can be transferred from an idle position, in which the partition area is not closed, into a closed position in case of a fire. The protective curtain comprises at least two material webs that adjoin one another and partially overlap one another in the closed position, wherein the lower edge of the material webs that points toward the floor of the partition area is spaced apart from the floor in the closed position.

The proposed solution normally provides an unrestricted open crossing between the sections of the rail vehicle. In case of a fire, the protective curtain of the fire protection apparatus is activated, for example, by a fire detection system and unfolds in the partition area from the ceiling in the direction toward the floor of the partition area, however, without reaching the floor. The protective curtain is realized in such a way that the passengers can still escape through the partition area.

The protective curtain provides protection, in particular, against a spread of smoke and/or fire or can at least significantly delay a spread of smoke and/or fire.

For this purpose, the protective curtain features at least two material webs, typically several material webs, that adjoin one another and partially overlap one another in the closed position. The individual material webs therefore are narrower than the clear width of the partition area and jointly form a closed protective curtain that, however, remains flexible. It is advantageous if the overlapping material webs are also in planar contact with one another in order to thusly increase the overall imperviousness of the protective curtain.

An adequate smoke barrier is realized even if the protective curtain does not completely close the partition area, but rather leaves open a gap at the floor. The protective curtain also can at least inhibit and delay the spread of a fire.

On the other hand, the activated protective curtain still allows the passengers to quickly transfer into a smoke-free section of the vehicle. Due to its design in the form of individual material webs, the protective curtain does not represent an impenetrable barrier. In fact, the passengers can push aside, raise or crawl underneath individual material webs in order to thusly pass through the protective curtain.

After passengers have passed through the protective curtain, the protective curtain closes again on its own and therefore fulfills its isolating function.

According to an embodiment, the protective curtain closes at least ⅔ of the headroom of the partition area in the closed position starting from the upper end, but does not completely close the partition area. The protective curtain therefore closes the majority of the passage opening. The smaller the remaining open area, the more effectively the protective curtain can counteract a spread of smoke and fire.

On the other hand, the remaining open area signals the passengers a means of escape. This can be optically intensified with suitable lamps in the floor area.

It is furthermore advantageous that passengers can also crawl underneath the protective curtain, if so required. Due to the design in the form of material webs, it is not necessary to raise the protective curtain in case the space underneath the protective curtain does not suffice, namely because the material webs can be simply pushed apart. This is ensured in that the material webs are not rigidly connected to one another, but rather are preferably in loose planar contact with one another in the overlapping regions. Different colors of the material webs such as, for example, at least two colors provide the optical impression that the protective curtain can be penetrated as a means of escape.

According to an embodiment, the individual material webs feature chain-shaped weights on their lower end. The chain-shaped weights ensure that the material webs are reliably unfolded and stretched when the protective curtain is activated due to the weight of the weights. On the other hand, they still provide the material webs with a certain flexibility such that passengers can easily push aside the material webs.

According to an embodiment, the material webs of the protective curtain are accommodated in the fire protection apparatus in a folded configuration in their idle state, wherein no fixed folding lines are provided in the material webs. The material webs are preferably formed of smooth webs without fixed folding edges or the like such that they can come into adequate planar contact with one another in the overlapping regions and thusly provide a highly effective barrier. Fixed folding lines produced in the material webs, in contrast, prevent the material webs from having a continuously smooth surface. A smoke barrier due to planar contact therefore can only be realized conditionally in this case.

According to an embodiment, the underside of the folded protective curtain forms the end of the ceiling lining toward the passenger compartment. This makes it possible to realize a very flat construction.

According to an embodiment, the protective curtain is in contact with the adjacent sidewalls of the partition area in the closed position. In this way, a barrier toward the sidewalls is also realized. If so required, corresponding projections that are available for a planar contact with the outer material webs may be provided on the sidewalls.

According to an embodiment, the fire protection apparatus is realized in the form of a ceiling cartridge or ceiling panel with a flat construction that either replaces or is attached to the ceiling lining or cover. The ceiling cartridge or panel therefore can replace, for example, part of the ceiling lining. This allows a space-saving arrangement. The ceiling cartridge or ceiling panel can include a housing which accommodates the protective curtain. The housing can be fixed to the ceiling or the body shell, and the upper end of the protective curtain is fixed to the housing.

According to an embodiment, the entire cartridge or panel arrangement can be exchanged. This simplifies the replacement of a fire protection apparatus for revision purposes or after the fire protection apparatus was activated. For example, the housing of the cartridge arrangement can be releasably mounted to the body shell or the ceiling.

According to an embodiment, the fire protection apparatus comprises an electromechanical activation mechanism that is coupled to a fire detection system, wherein the electromechanical activation mechanism triggers automatically when it receives a corresponding signal from the fire detection system.

According to an embodiment, the material webs are realized in the form of fabric webs that have different colors. This improves the optical signaling effect with respect to a means of escape.

According to an embodiment, the overlapping area of the partially overlapping material webs amounts to at least approximately 25% of the width of a material web. A sufficient barrier, particularly against smoke, is achieved in this way.

According to an embodiment, the gap between the lower edge of the material webs that in the closed position points toward the floor of the partition area and the floor has a height between 10 cm and 100 cm, preferably 50 cm.

According to an embodiment, lamps or lightning means are arranged in the floor area in order to enable passengers to better orient themselves in case of a fire. The lamps are activated simultaneously with the activation of the fire protection apparatus.

According to an embodiment, a rail vehicle car with a coupling area for being coupled to another rail vehicle car is proposed, wherein the coupling area forms a crossing between the two rail vehicle cars for passengers in the coupled state. A fire protection apparatus is mounted in the ceiling region of the coupling area and comprises a protective curtain that can be transferred from an idle position, in which the crossing of the coupling area is not closed, into a closed position in case of a fire. The protective curtain is composed of several material webs that adjoin one another in a planar fashion and partially overlap one another in the closed position, wherein the lower edge of the material webs that points toward the floor of the coupling area is spaced apart from the floor in the closed position.

According to an embodiment, the individual material webs feature chain-shaped weights on their lower end.

According to an embodiment, the lateral material webs are in contact with the adjacent sidewalls of the coupling area.

According to an embodiment, a rail vehicle with at least one rail vehicle car that features at least one partition area and at least one fire protection apparatus of the above-described type in the region of the partition area is made available.

According to an embodiment, two sections within the rail vehicle car, particularly within a high-capacity car or saloon carriage car, can be isolated from one another by means of the activated protective curtain in case of a fire.

According to an embodiment, the partition area is a coupling area for being coupled to another rail vehicle car, wherein the coupling area forms a crossing between the two rail vehicle cars for passengers in the coupled state.

The invention can be utilized in vehicles and, in particular, rail vehicles of all types such as streetcars or trams, metropolitan railroads, subways, people movers or other rail vehicles with open crossings between the individual cars of an interconnected train. The invention is also suitable for road vehicles (buses) or other vehicles with open crossings between car sections.

BRIEF DESCRIPTION OF THE DRAWINGS

Embodiments are illustrated in the attached drawings that serve for elucidating the principles of the invention in conjunction with the description. The elements of the drawings are relative to one another and not necessarily true-to-scale. Similar components are identified by the same reference symbols.

DETAILED DESCRIPTION OF THE INVENTION

Embodiments of fire protection apparatuses are described below. These fire protection apparatuses are typically integrated into partition areas or coupling areas of vehicles, particularly rail vehicles. The following exemplary embodiments elucidate the invention with reference to a rail vehicle, but are not limited to rail vehicles only.

Figure 1B:
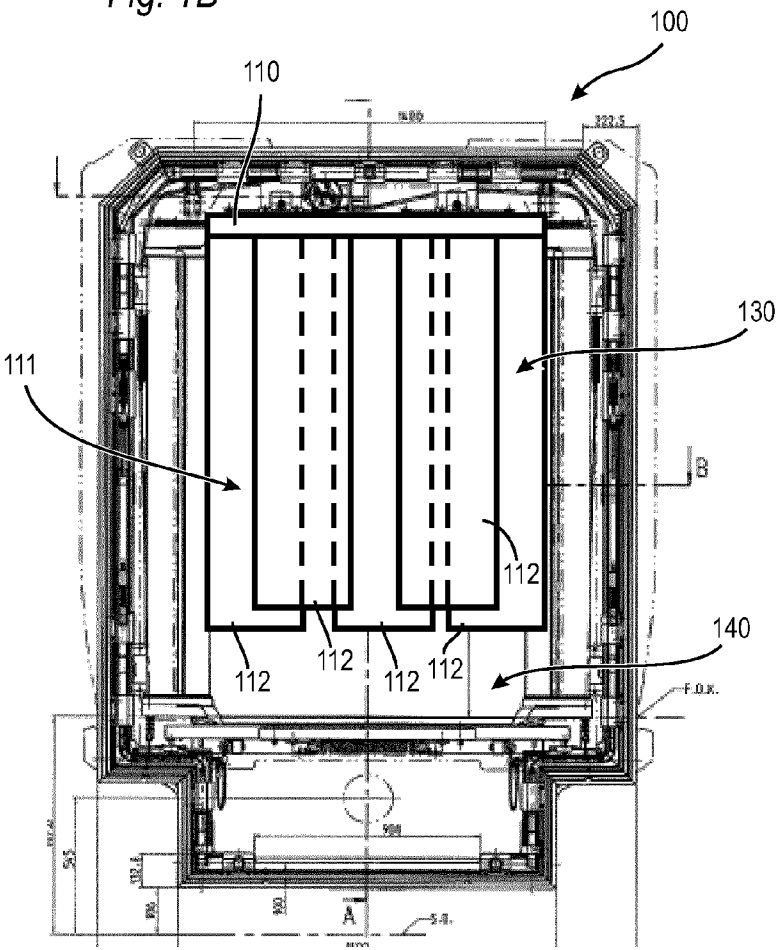
FIGS. 1A and 1B show cross sections through a partition area of a rail vehicle car according to an embodiment of the invention, wherein the protective curtain is activated in FIG. 1B.
Figure 1A:
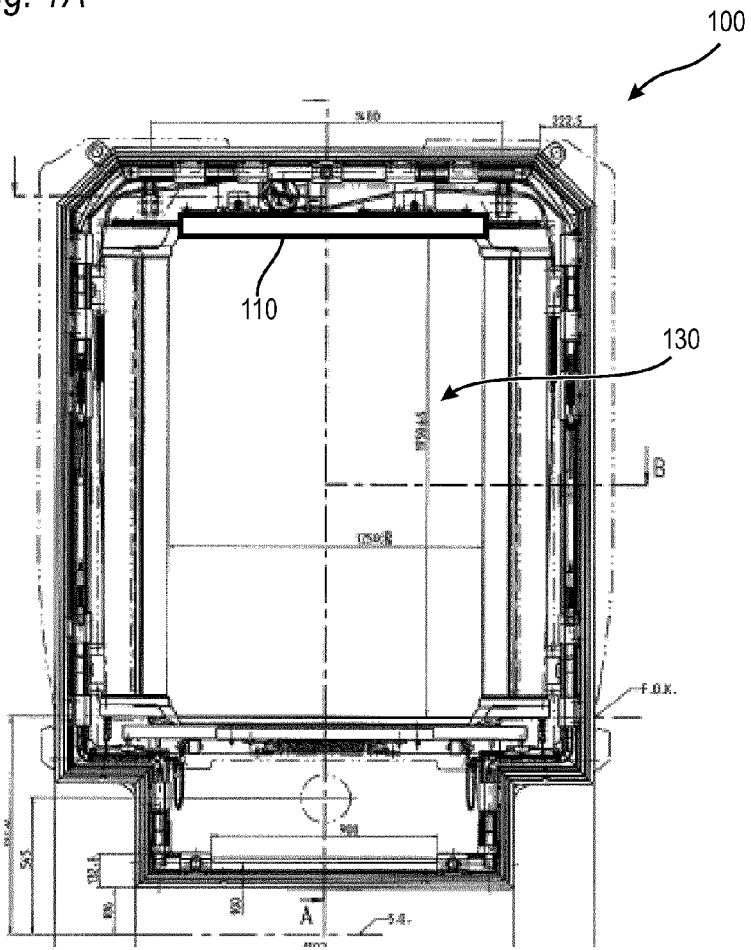

FIGS. 1A and 1B show cross sections through a partition area or coupling area of a rail vehicle 100, wherein the protective curtain is activated in FIG. 1B.

A fire protection apparatus 110 is mounted in the ceiling region of the partition area. The fire protection apparatus is realized comparatively flat such that it can be arranged in a space-saving fashion. Due to the flat construction, no encroachment or only a slight encroachment of the headroom occurs. A folded smoke and protective curtain 111 is accommodated in the fire protection apparatus 110.

The fire protection apparatus 110 features or is equipped with an electromechanical activation mechanism. When this activation mechanism is actuated, the folded smoke curtain and protective curtain 111 drops down due to its own weight and closes the passage opening 130 of the partition area similar to a curtain.

Chain-shaped weights may be sewn into the lower hem of the individual material webs 112 of the protective curtain 111. These weights ensure that the protective curtain 111 unfolds and is suspended in a taut fashion.

The length of the material webs 112 is chosen such that at least approximately ⅔ of the clear height of the passage opening 130 are covered. The material webs 112 may end a short distance above the floor of the partition area and therefore almost completely close the passage opening 130. The uncovered part or gap 140 on the bottom ensures the escape path and provides the passengers with the optical impression that an escape path exists.

The protective curtain 111 preferably consist of strip-shaped material webs such as, for example, fabric webs that are arranged in an overlapping fashion. The overlap is chosen such that a spread of smoke and/or fire is respectively prevented or delayed on the one hand and an escape path for passengers is ensured on the other hand. The individual fabric webs may alternately have different colors.

A material with the following properties is preferably chosen for the fabric of the individual material webs 112 of the protective curtain 111: it should be impervious to smoke and fire resistant. It should also be possible to flatly fold and compactly stow the material. The material should be as thin and lightweight as possible and have an adequate long-term storage life in the folded state, i.e., it should not be prone, for example, to molding. Suitable materials are, for example, glass fiber materials, fine-mesh metallic fabrics, mineral fabrics, if so required with additional coatings, and foil materials.

The fire protection apparatus 110 may be realized, for example, in the form of a ceiling cartridge or panel with a folded protective curtain. The ceiling cartridge or panel comprises, for example, an arrangement with a flat construction that either replaces the ceiling lining of the partition area or is attached thereto. The protective curtain 111 is accommodated therein in a flatly folded state. The opening mechanism is preferably realized such that no flap components protrude in the activated state and there is no risk of injuries to the passengers. Corresponding means hold the folded protective curtain in its position in the idle state. If applicable, the underside of the folded protective curtain 111 forms the lower end of the fire protection apparatus 110, i.e., the protective curtain 111 is visible toward the passenger compartment. The protective curtain 111 may be provided with a suitable design for this purpose.

The protective curtain is automatically or manually activated by a fire detection system or by other means. An activation device integrated into the fire protection apparatus, particularly into the ceiling panel, releases the folded protective curtain 111 on one end such that it drops down and unfolds due to its own weight. The upper end of the protective curtain 111 is rigidly connected to the ceiling cartridge or panel and remains therein. The weights incorporated into the lower end of the hem of the material webs 112 in the form of a chain or similar articulated weights promote the dropping of the protective curtain and also suspend the protective curtain in a sufficiently taut fashion. The weights are preferably flexible similar to a chain such that they do not impair the escape path.

The protective curtain 111 is divided into overlapping material webs 112 such that persons can still pass through the protective curtain (escape path). In FIG. 1B, the overlap is indicated with the edges of the partially covered material webs 112 that are illustrated with broken lines.

The extent of the overlap can be suitably chosen. According to an embodiment, the overlapping area amounts to at least approximately 25% of the width of a web.

According to an embodiment, the individual material webs adjoin one another very closely in a planar fashion in their overlapping regions such that no or only little smoke penetrates the protective curtain 111. According to an embodiment, the lateral material webs 112 contact the adjacent sidewall of the partition area such that the protective curtain is also sufficiently impervious to smoke at these locations. In order to improve the planar contact, the protective curtain is not provided with any fixed folding lines that could prevent the material webs from being smoothly suspended and therefore from contacting one another in a planar fashion.

Figure 2B:
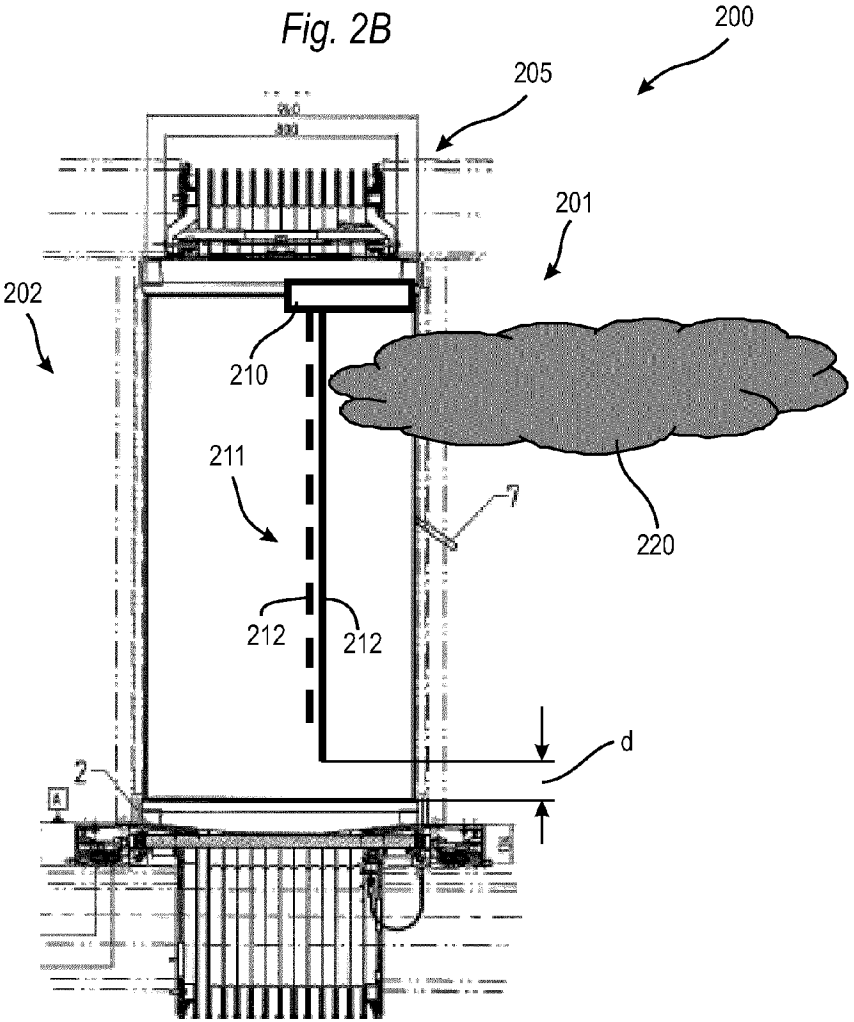
FIGS. 2A and 2B show longitudinal sections through a coupling area of a rail vehicle car according to an embodiment of the invention, wherein the protective curtain is activated in FIG. 2B.
Figure 2A:
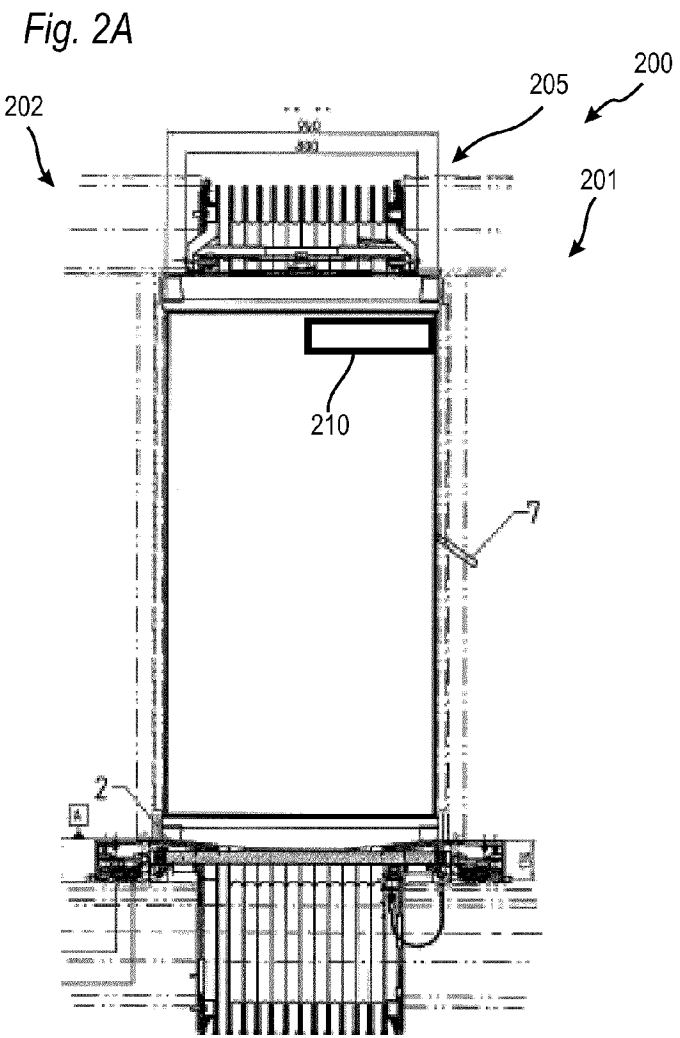

FIGS. 2A and 2B show an exemplary embodiment of a coupling area 205 of a rail vehicle car 201 that is coupled to a second rail vehicle car 202 and represents part of a rail vehicle 200. The coupling area forms a partition area in this case. The panel of the fire protection apparatus 210, in which the protective curtain 211 is accommodated in a folded configuration, is mounted in the ceiling region of the coupling area 205. After the activation, the free ends of the material webs 212 drop down due to their own weight or due to additional weights and a closed protective curtain 211 is formed.

The free end of the material webs 212 is spaced apart from the floor and leaves open a gap with a height d. The gap height d may lie, for example, between 10 cm and 100 cm, preferably at 50 cm.

Despite this gap, the protective curtain 211 effectively counteracts a spread of smoke 220.

After the activation of the protective curtain, the entire cartridge or panel arrangement is removed and replaced with a new cartridge or panel arrangement. The removed panel may be newly repackaged and the activated protective curtain can be refolded therein if it is still intact, for example, at the manufacturing facility or in a railroad workshop. It may also be repaired, if so required.

The fire protection apparatus may also be arranged in the ceiling region of the vehicle outside the coupling area in order to create a partition area between two sections of the rail vehicle at this location in case of a fire. For example, the protective curtain can isolate two sections within an open high-capacity car or also other passenger areas within a rail vehicle car from one another in case of a fire in order to prevent or at least delay the spread of smoke and/or fire.

The above-described embodiments can be arbitrarily combined with one another.

Although specific embodiments were elucidated and described herein, the present invention also allows suitable modifications of the illustrated embodiments without deviating from the protective scope of the present invention. The following claims represent a first, non-binding attempt to generally define the invention.

LIST OF REFERENCE SYMBOLS

100 Rail vehicle
110, 210 Fire protection apparatus
111, 211 Protective curtain
112, 212 Material web
130 Passage opening
140 Gap
200 Rail vehicle
201 First rail vehicle car
202 Second rail vehicle car
205 Coupling area
220 Smoke

The invention claimed is:

1. A vehicle with a partition area for passengers between two sections of the vehicle comprising:

a fire protection apparatus mounted in a ceiling region of the partition area and a protective curtain that can be transferred from an idle position, in which the partition area is open, into a closed position in case of a fire, wherein the protective curtain is composed of several material webs that adjoin one another in a planar fashion and partially overlap one another in the closed position, wherein a lower edge of the material webs that points toward a floor of the partition area is spaced apart from the floor in the closed position, wherein the material webs are accommodated in the fire protection apparatus in a folded configuration in the idle position of the protective curtain, wherein no fixed folding lines are provided in the material webs, wherein an underside of the folded protective curtain forms an end of a ceiling lining toward the passenger compartment, and wherein the fire protection apparatus is formed as a ceiling panel with a flat construction that either replaces or is attached to a lining of the ceiling region.

2. The vehicle according to claim 1, wherein the protective curtain closes at least ⅔ of a headroom of the partition area in the closed position starting from an upper end, but does not completely close the partition area.

3. The vehicle according to claim 1, wherein the individual material webs comprise respective chain-shaped weights on a lower end.

4. The vehicle according to claim 1, wherein the material webs of the protective curtain are accommodated in the fire protection apparatus in a folded configuration in their idle state, wherein no fixed folding lines are provided in the material webs.

5. The vehicle according to claim 1, wherein the protective curtain is in contact with adjacent sidewalls of the partition area in the closed position.

6. The vehicle according to claim 1, wherein an entire panel arrangement can be exchanged.

7. The vehicle according to claim 1, wherein the fire protection apparatus comprises an electromechanical activation mechanism that is coupled to a fire detection system, wherein the electromechanical activation mechanism triggers automatically when it receives a corresponding signal from the fire detection system.

8. The vehicle according to claim 1, wherein the material webs are formed as fabric webs with different colors.

9. The vehicle according to claim 1, wherein an overlapping area of the partially overlapping material webs amounts to at least approximately 25% of a width of a web.

10. The vehicle according to claim 1, wherein a gap between a lower edge of the material webs that in the closed position points toward the floor of the partition area and the floor has a height between 10 cm and 100 cm.

11. The vehicle according to claim 1, wherein lamps are arranged in the floor.

12. A rail vehicle with at least one rail vehicle car that comprises at least one the partition area and at least one fire protection apparatus in a region of the partition area in accordance with claim 1.

13. The rail vehicle according to claim 12, wherein two sections within the rail vehicle car can be separated from one another by an activated protective curtain in case of a fire.

14. The rail vehicle according to claim 12, wherein the partition area is a coupling area for being coupled to another rail vehicle car, wherein the coupling area forms a crossing between two rail vehicle cars for passengers in the coupled state.

* * * * *